US005585593A

United States Patent [19]

Villamagna et al.

[11] Patent Number: 5,585,593

[45] Date of Patent: Dec. 17, 1996

[54] INERT STEMMING MATERIALS

[75] Inventors: Fortunato Villamagna, Slatington, Pa.; Melvin A. McNicol, Quebec, Canada; Curtis P. Link, Tamaqua, Pa.

[73] Assignee: ICI Explosives USA Inc., Tamaqua, Pa.

[21] Appl. No.: 225,850

[22] Filed: Apr. 11, 1994

[51] Int. Cl.[6] ..... F42D 3/00

[52] U.S. Cl. ..... 102/333; 102/324; 166/135

[58] Field of Search ..... 102/333, 324; 166/135

[56] References Cited

U.S. PATENT DOCUMENTS

| | | | |
|---|---|---|---|
| 2,007,568 | 7/1935 | Heitzman | 102/333 |
| 2,296,504 | 9/1942 | Crater | 102/333 |
| 3,819,429 | 6/1974 | Schafer | 102/333 |
| 4,214,532 | 7/1980 | Oulsnam | 102/333 |
| 4,869,173 | 9/1989 | Brown | 102/333 |

FOREIGN PATENT DOCUMENTS

| | | | |
|---|---|---|---|
| 1300853 | 8/1969 | Germany | 102/333 |
| 2227816 | 8/1990 | United Kingdom | 102/333 |

*Primary Examiner*—Peter A. Nelson
*Attorney, Agent, or Firm*—Charles Q. Buckwalter, Jr.

[57] ABSTRACT

A stemming agent is provided comprising: A) a neutralized acrylic acid polymer; B) a neutralized mixture of sodium silicate and a silicon oxide-containing material such as sand, clay, stones, volcanic ash, or the like; or C) a mixture of materials A) and B). The stemming agents produced are low cost, easily made, and preferably are free of nitrate salts. Accordingly, the use of these preferred stemming agents eliminates the contamination of ground water by nitrate salts. The stemming agents of the invention may be used in either bulk-delivered or packaged applications.

15 Claims, No Drawings

INERT STEMMING MATERIALS

FIELD OF THE INVENTION

This invention relates to explosives blasting technology, and more particularly, to the stemming material used during such blasting.

DESCRIPTION OF THE RELATED ART

In explosive blasting operations, such as in mining or construction, the blast is usually conducted by partially filling a drilled borehole with packaged or bulk explosives. In order to minimize the loss of explosive energy out of the borehole, it is normally desirable to provide a stemming material at, or near, the top of the borehole. This stemming material is generally gravel or drill cuttings which are poured or packed into the top of the borehole, after the explosive material has been loaded into the bottom of the borehole. The stemming material thus forms a blockage to prevent the force of the explosive, and the explosive itself, from being propelled out of the borehole, when the explosive material is detonated. Stemming may also be used to control the location of the explosive charge in the borehole, in, for example, decking applications, up-hole plugs, drill-through plugs and the like.

Stemming may thus be defined as any inert, or more generally, any non-detonable material placed in the borehole in order to prevent premature release of gasses, or to control the location of, or properties of the explosive in the borehole. Control of the location of the explosive is self-explanatory. However, it is also of interest to control the release of gas, since if the detonation gases escape prematurely, the gas versus time profile in the hole will be compromised. This will result in poor fragmentation and poor movement of the burden rock. In some applications the stemming is also used to minimize the amount of hot particles/gas which are ejected from the hole. The hot material has, under certain conditions, ignited gasses in underground mines.

A feature of desirable stemming materials is that they must be essentially free from shrinkage after loading into the borehole. Any such shrinkage could result in the creation of a loose mass which would be projected from the borehole when the explosive is detonated. Further, premature ejection of the stemming may also result in increased noise levels from the blast.

The "classical" stemming materials are drill cuttings, gravel, mud or clay. However, almost all current packaged and pumpable stemming compositions are gelled solutions of nitrate salts, or are formulations containing nitrate salts. Since the stemming material is not consumed in the detonation and remains in the muck pile, the components of the stemming are then free to disperse and possibly enter the ground water system if they are water soluble. This entry in the ground water system creates the possibility of significant ground water nitrate contamination.

Accordingly, in its preferred embodiment, it would be desirable to provide a nitrate-free stemming material for use in bulk or packaged explosive blasting.

Further, during bulk applications, such as in a mine, a stemming crew is usually employed to manually load the stemming into the borehole. This procedure can be time consuming and labour intensive, and thus, expensive for the mine. An automated means of loading stemming material would significantly improve productivity for the mine and thereby reduce operating costs.

In summary, it would be desirable to provide a stemming material which was nitrate-free; which could be used in both packaged or bulk pumpable applications; which had reduced labour costs for bulk applications; provided improved efficiency for bulk applications; and/or which could be formulated to provide any given stiffness required.

SUMMARY OF THE INVENTION

These, and other features of the present invention are provided by a stemming agent comprising:

A) 0–100% by weight of a solution of a neutralized acrylic acid polymer,and

B) 0–100% by weight of a mixture of from about 1 to 95, and preferably 10 to 75, weight percent of a silicon oxide-containing material combined with a neutralized silicate solution, and combinations thereof.

In a preferred embodiment, the stemming agent comprises 100 weight percent of an aqueous neutralized acrylic acid polymer.

In an alternative embodiment, the stemming agent of the present invention comprises 100 weight percent of a mixture of from about 1 to 95, and preferably 10 to 70, weight percent silicon oxide, and preferably, a silicon dioxide-containing material combined with a neutralized silicate solution.

It is particularly preferred that the stemming agent be nitrate free.

One possible combination, according to the present invention, is one wherein the acrylic acid polymer of A) is combined with the silicon oxide/silicate solution material described in B).

DESCRIPTION OF THE PREFERRED EMBODIMENTS

The invention in this application consists of two materials which are designated as material "A" or material "B" which individually, or in combination, can be used as inert stemming materials.

Material A

Material A is a acrylic acid polymer, which may be generally defined as any polymer, or copolymer, which contains an acrylic acid residue. A preferred acrylic acid polymer of use in the present invention are materials sold under the trade name Carbopol*. Chemically, Carbopol resins are acrylic acid polymers wherein the individual resins may vary by molecular weight and degree of crosslinking. Differences in molecular weight and crosslinking account for variations in thickening efficiency and flow among the individual Carbopol products. Preferred acrylic acid polymers have a molecular weight of from about 400,000 to about 5,000,000, and have an un-neutralized aqueous solution pH of about 2 to 4. As neutralizing agent is added (generally a basic material), the viscosity of the aqueous solution increases rapidly.

*Trade Mark

While it is preferable that the acrylic acid polymer solution is an aqueous solution, it is possible for the acrylic acid solution to be a non-aqueous system.

These polymers are generally tightly coiled in their pre-solvated state, thus limiting their thickening capability. When dispersed in water, the molecule begins to hydrate and uncoils to some extent, generating an increase in viscosity. However, to achieve the highest possible viscosity with these polymers, the molecule is preferably completely uncoiled. This is accomplished by neutralizing the polymer with a base. The degree of neutralization can thus control the viscosity of the solution. Suitable bases may be any compatible basic material. Preferred basic material include, for example diethanolamine or sodium carbonate.

Neutralization ionizes the acidic groups of the polymer, generating negative charges along the polymer backbone. Repulsions of these like negative charges cause the molecule to completely uncoil into an extended structure. This reaction is rapid and gives essentially instantaneous thickening.

Resins comprising acrylic acid polymers may also be used to thicken non-aqueous mediums. However, in these solvent systems, the neutralizing agent must be chosen more carefully.

Generally, only a small amount of the acrylic acid polymer is required in order to provide the desired viscosity level. Accordingly, a thickened material prepared from material "A" preferably consists of 99.0 to 9.9% water and 0.1 to 1.0% acrylic acid polymer (on solids), by weight. This thickened material can be used as an effective stemming material for packaged and bulk pumpable applications. Higher polymer concentrations, such as up to 3, 5 or even up to 20%, can be used to further increase the viscosity and yield (e.g. the apparent viscosity) values.

Another means of increasing yield, or the apparent viscosity, is to incorporate 1 to 95% by weight of solid additives such as clays, sand, ceramic or plastic beads, etc., to give the gel a "stiffer" consistency. Preferably, however, the solids level will be in the range of from 1 to 50%, and more preferably, at a level of from 5 to 20%. At these solid levels the blend will remain pumpable and provide a firm gel. The amount of added material will be dependent on the particle size of the material added, and its effect on the desired viscosity of the stemming material.

A preferred method for the utilization of the stemming material provided by material "A", is its use as a packaged material. For example, the material may be formed and loaded into suitable containers, wherein the viscosity of the product will increase. The container may then be shipped to the borehole site, where it is loaded into the borehole, and tamped into place.

Material B

The formation of silica based gels has been well documented and the reactions of sodium silicate solutions, in particular, in acidic media, has been thoroughly studied. One application of this technology has been to increase the strength of sand mounds. However, the use of this type of material as a stemming agent has heretofore not been described. Accordingly, the production of material "B" of the present invention, involves the blending of 1 to 95%, and preferably 10 to 70%, of a silicon oxide-containing material, preferably a silicon dioxide-containing material such as sand, and most preferably a fine sand, with 99 to 5%, or more preferably 90 to 30%, by weight, of a silicate solution. Preferably, the silicate solution is a concentrated sodium silicate solution.

These ingredients are mixed until a uniform slurry forms. The slurry, or more particularly, the silicate solution, is then partially or completely, neutralized by the addition of an acidic material, which acidic material is preferably a weak mineral acid, an organic acid, an acid anhydride, or a carbonate, preferably propylene carbonate.

In order to provide stability for stemming material which is in contact with standing water in the borehole, it is preferable that the selected acid have a low water solubility.

When added, the acid initiates the growth of fibre-like silicate strands between the particles of silicon oxide-containing materials, effectively cementing the mixture.

While sand is a preferred material as the silicon oxide-containing material, it should be noted that other silicon oxide-containing materials, such as, for example, drill hole cuttings, clay, stones, volcanic ash, or any of the naturally occurring minerals such as feldspar or quartz, or the like, or combinations thereof, may be used.

The preferred concentrated sodium silicate solution typically contains from 30 to 60% of a mixture of $SiO_2$ and $Na_2O$ in a 3:1 ratio.

Those skilled in the art will be aware that the cementing time depends on, inter alia, the ratio of silicon oxide-containing material to silicate, the concentration of the silicate solution, the concentration of the neutralizing acid, and the amount of acid used.

Preferably, the slurry is poured, pumped or augured into a borehole while the neutralizing acid is added in-line. The blend will typically solidify in the borehole within 15 to 30 minutes. It should be noted, that, in general, the stemming material formed by material "B" is typically more rigid than the stemming material of material "A". Thus, material "B" is preferable for large scale bulk applications wherein the stemming material is formed on-site. This increased rigidity of the stemming agent produced by material "B" might provide a stemming agent which would be difficult to load into a borehole and/or tamp into place for package stemming materials. Other thickening materials, known within the industry, such as guar, and the like, may also be added to the stemming material provided by material "B". However, a preferred thickening material is that provided in the present invention as material "A", as described hereinbelow.

Blends of Material A and Material B

It should also be noted that the stemming material resulting from material "B" may be adversely affected by the presence of water in the borehole. Since the presence of ground water, and the like, is not uncommon in boreholes, it is possible that the silicate solution, will be diluted. This dilution will retard the reaction and may even prevent sufficient cementing from taking place.

One means of overcoming the problem of dilution is to gel the sodium silicate solution with an acrylic acid polymer and blend the silicon oxide-containing material with the gelled solution. The gelled slurry will be pumpable and a weak acid or acid solution can be added in-line to initiate the cementing reaction.

The level of neutralizing agent utilized in the practise of the present invention may vary depending on the nature of the conditions in the bore hole. For example, the composition of the surrounding rock in the bore hole may affect the pH of the stemming material. Accordingly, the level of neutralizing agent or neutralizing material may need to be adjusted to suit the conditions of the bore hole.

The silicate solution used, and in particular, the sodium silicate solutions used, will typically have high pH values. At these pH values, conventional gelling agents such as guar gum, carboxymethyl cellulose, or xantham gum either do not function at all, or large amounts (>10%) must be used to obtain even marginal thickening. Currently, the majority of pumpable inert stemming compositions use guar gum to thicken nitrate salt solutions. These nitrate salts are added to allow the guars to function properly, act as freezing point depressants, and for their good solubility characteristics at very low temperatures.

Acrylic acid polymer gels typically form at concentrations of <1% and preferably at pH values of less than 10. The freezing point of the solution can be reduced using conventional depressants such as ethylene glycol or alcohols, which do not effect the gel structure, and thus, will eliminate the contamination of the ground water with nitrate salts. Further, since the amount of acrylic polymer is small, there is little overall contamination of the ground water by the stemming material.

The stemming materials of the present invention thus provides desirable advantages over the prior art stemming materials.

The invention will now be described by way of example only, with reference to the following examples.

EXAMPLE

Mixture A

A system of nitrate-free stemming material was prepared in accordance with Mixture A of the present invention by neutralization of a acrylic acid polymer in water. The neutralizing agent was typically diethanolamine (DEA) which was added in incremental amounts. The viscosity of the mixture was measured after each addition of DEA.

The acrylic acid polymer used throughout these examples are sold under the trade mark "Carbopol", and are available from B. F. Goodrich. Various Carbopol resins were used in the following examples. These resins have the following molecular weights:

| | |
|---|---|
| Carbopol 676 | 4,500,000 |
| Carbopol 690 | 4,000,000 |
| Carbopol 679 | 450,000 |

Other resins having different molecular weights are also available.

1) The effect of pH on the viscosity of an acrylic acid polymer is demonstrated in the following example.

| Formula: | 99.5% tap $H_2O$<br>.5% Carbopol 690<br>200 gram batch | | |
|---|---|---|---|
| Total DEA* Added | pH | Visc. (CPS) | Comments |
| — | 3–4 | — | |
| .2 g | 5 | 31,000 | |
| 0.4 g | 6 | 45,000 | |
| 0.6 g | 7 | 47,000 | |
| 0.8 g | 8 | 47,000 | |
| 1.0 g | 9 | 51,000 | Transparent Gel |
| After 4 hrs. | | 51,000 | Transparent Gel |

* — Diethanolamine

The sample prepared was retained for testing of long term storage in cold temperatures. The sample was placed in a freezer at −10° F. (−23° C.) for 24 hrs. The sample froze solid, but after 4 hrs. at 70° F. (21° C.), returned to good condition.

2) The effect of different water sources (i.e. tap versus deionized water) was studied.

| Formula: | 99.5% Deionized $H_2O$<br>.5% Carbopol 690 | | 200 gram batch |
|---|---|---|---|
| Total DEA Added | pH | Visc. (CPS) | Comments |
| — | 4 | — | |
| .2 g | 5–6 | 38,000 | |
| 0.4 g | 6 | 45,000 | |
| 0.6 g | 7 | 52,000 | |
| 0.8 g | 8 | 53,000 | |
| 1.0 g | 9 | 53,000 | Transparent Gel |
| After 4 hrs. | | 54,000 | Transparent Gel |

3) The effect of a freezing point depressant was studied.

| Formula: | 99.5% 25/75 EG (ethylene glycol)/$H_2O$<br>0.5% Carbopol 690<br>200 gram batch | | |
|---|---|---|---|
| Total DEA Added | pH | Visc. (CPS) | Comments |
| — | 4–5 | — | |
| .2 g | 6 | 33,000 | |
| 0.4 g | 7 | 41,000 | |
| 0.6 g | 8 | 51,000 | |
| 0.8 g | 9 | 52,000 | Transparent Gel |
| After 4 hrs. | | 55,000 | Transparent Gel |

The sample was placed in a −10° F. (−23° C.) freezer for 24 hrs. The sample was slushy, but was not frozen. After 4 hrs. at 70° F. (21° C.), the sample returned to good condition.

4) Further testing was conducted on a system using a freezing point depressant.

| Formula: | 99.5% 50/50 EG/$H_2O$ (tap)<br>.5% Carbopol 690 | | |
|---|---|---|---|
| Total DEA Added | pH | Visc. (CPS) | Comments |
| — | 5 | — | |
| .2 g | 6 | 13,000 | |
| 0.4 g | 7 | 34,000 | |
| 0.6 g | 7–8 | 42,000 | |
| 0.8 g | 8 | 48,000 | |
| 1.0 g | 9 | 52,000 | Transparent Gel |
| After 3 hrs. | | 58,000 | Transparent Gel |

The sample was placed in a −10° F. (−23° C.) freezer for 24 hrs. The sample remained in excellent condition, and did not freeze. The sample was also tested at −30° F. (−34° C.) freezer, and remained in excellent condition without freezing.

5) A further test utilizing a different freezing point depressant was tested.

| Formula: | 74.6% $H_2O$ (tap)<br>24.9% Methanol<br>0.5% Carbopol 690<br>100.0% 200 gram batch | | |
|---|---|---|---|
| Total DEA Added | pH | Visc. (CPS) | Comments |
| — | 4 | — | |
| .2 g | 5–6 | 22,000 | |
| 0.4 g | 6 | 32,000 | |
| 0.6 g | 7 | 40,000 | |
| 0.8 g | 7–8 | 45,000 | |
| 1.0 g | 8 | 48,000 | Transparent Gel |
| +2 hrs. | | 51,000 | Transparent Gel |

The sample was placed in a −10° F. (−23° C.) freezer for 24 hrs., and froze to a slushy state. After 4 hrs. at 70° F. (21° C.) the sample returned to its normal state.

6) A further test using methanol as a freezing point depressant was conducted.

| Formula: | 49.75% $H_2O$ (tap)<br>49.75% Methanol<br>0.50% Carbopol 690<br>100.0% 200 gram batch |
|---|---|

| Total DEA Added | pH | Visc. (CPS) | Comments |
|---|---|---|---|
| — | 4 | — | |
| .2 g | 5–6 | 18,000 | |
| 0.4 g | 6 | 26,000 | |
| 0.6 g | 6 | 36,000 | |
| 0.8 g | 6–7 | 40,000 | |
| 1.0 g | 7–8 | 41,000 | |
| 1.2 g | 9 | 41,000 | Transparent Gel |
| After 1 hr. | | 42,000 | Transparent Gel |

Sample taken for long term storage. After 24 hrs at −10° F. (−23° C.), the sample remained in good condition.

7)

| Formula: | 49.75% $H_2O$ (tap)<br>49.75% Methanol<br>0.50% Carbopol 676<br>100.0% 200 gram batch |
|---|---|

| Total DEA Added | pH | Visc. (CPS) | Comments |
|---|---|---|---|
| — | 4 | — | |
| .2 g | 5 | 32,000 | |
| 0.4 g | 6 | 51,000 | |
| 0.6 g | 6–7 | 56,000 | |
| 0.8 g | 7 | 60,000 | |
| 1.0 g | 9 | 63,000 | Transparent Gel |

Sample taken for long term storage. After 24 hrs. at −10° F. (−23° C.), the sample had frozen solid. When returned to 70° F. (21° C.) the sample returned to its normal state.

8)

| Formula: | 49.75% $H_2O$ (tap)<br>49.75% Ethyl Glycol<br>0.50% Carbopol 676 | 200 gram batch |
|---|---|---|

| Total DEA Added | pH | Visc. (CPS) | Comments |
|---|---|---|---|
| — | 5 | — | |
| .2 g | 6 | 23,000 | |
| 0.4 g | 6–7 | 45,000 | |
| 0.6 g | 7 | 57,000 | |
| 0.8 g | 8 | 62,000 | |
| 1.0 g | 8–9 | 64,000 | Transparent Gel |

Sample taken for long term storage. After 24 hrs at −10° F. (−23° C.), the sample remained in good condition.

9)

| Formula: | 50.0% $H_2O$ (tap)<br>49.5% Methanol<br>0.5% Carbopol 676 | 200 gram batch |
|---|---|---|

| Total DEA Added | pH | Visc. (CPS) | Comments |
|---|---|---|---|
| — | 5 | — | |
| .2 g | 5 | 17,000 | |

-continued

| | | | |
|---|---|---|---|
| 0.4 g | 6 | 37,000 | |
| 0.6 g | 6–7 | 48,000 | |
| 0.8 g | 7 | 51,000 | |
| 1.0 g | 8 | 52,000 | |
| 1.2 g | 9 | 55,000 | Transparent Gel |

Sample taken for long term storage. After 24 hrs at −10° F. (−23° C.), the sample remained in good condition.

10) A series of experiments were conducted wherein the acrylic acid copolymer was neutralized with a sodium silicate (available from PQ corp.) having a $SiO_2$ to $Na_2O$ ratio, and concentration as shown. The samples were mixed for 5 minutes at 50° C., with the exception of test No. 4 which was mixed for 10 minutes at 21° C.

| Test No. | Formulation | Result |
|---|---|---|
| 1 | 95% Sodium silicate (Ratio of 3.22:1, 41Be)<br>5% Carbopol 679 | Hard gel forms upon cooling — viscosity in excess of 200,000 CPS |
| 2 | 95% Sodium silicate (Ratio of 2.88:1, 47Be)<br>5% Carbopol 679 | Hard gel forms upon cooling — viscosity in excess of 200,000 CPS |
| 3 | 97.5% Sodium silicate (as in Test 1)<br>2.5% Carbopol 679 | Hard gel forms upon cooling — viscosity in excess of 200,000 CPS |
| 4 | 300 parts Sodium silicate (as in Test 1)<br>8 parts Carbopol 679<br>8 parts clay | Hard gel forms — viscosity in excess of 100,000 CPS |

11) Packaged Inert Stemming + Clay

This example was performed to study the effect of Celetom (clay) to increase viscosity in packaged stemming in small diameters.

| Test No. 1 | Test No. 2 | Test No. 3 |
|---|---|---|
| 98.5% $H_2O$<br>.5% Carbopol 690<br>1.0% Clay<br>58,000 CPS @ pH 9 | 94.5% $H_2O$<br>.5% Carbopol 690<br>5.0% Clay<br>73,000 CPS @ pH 9 | 89.5% $H_2O$<br>.5% Carbopol 690<br>10.0% Clay<br>85,000 CPS* @ pH 9 |

* — After 1 week storage, the viscosity was 84,000 CPS

12) This example is a continuation of the study of Example 11 with the addition of Ethylene Glycol as a freezing point depressant for Winter storage.

| Formula: | 50.0% $H_2O$ (tap)<br>49.5% EG<br>0.5% Carbopol 690<br>with an additional 10% clay added | 200 gram batch |
|---|---|---|

| Total DEA Added | pH | Visc. (CPS) | Comments |
|---|---|---|---|
| — | 4 | — | |
| .2 g | +5 | 18,000 | |
| 0.4 g | 6 | 49,000 | |
| 0.6 g | 6–7 | 80,000 | |
| 0.8 g | 7 | 100,000 | |
| 1.0 g | 7 | 106,000 | |
| 1.2 g | 8–9 | 111,000 | Excellent Rubbery Gel |

Sample taken for long term storage. After 24 hrs at −10° F. (−23° C.), the sample remained in good condition. After 1 week at ambient temperatures, the sample had a viscosity of 120,000 CPS.

13) This example was conducted in order to evaluate a system wherein the neutralizing agent used was sodium carbonate. A 10% solution of sodium carbonate (S.C.) in water was used.

| | |
|---|---|
| Formula: | 88.5% $H_2O$ |
| | 10.0% clay |
| | .5% Carbopol 676 |
| | 1.0% S.C. SOLN (10%) |

The resulting mixture had a viscosity of 76,000cps at a pH of 6.

14) A further series of tests were conducted using sodium carbonate. The results are as shown hereinbelow:

| | | |
|---|---|---|
| 14-i) | Formula: | 88.0% $H_2O$ |
| | | 10.0% clay |
| | | .5% Carbopol 676 |
| | | 1.5% S.C. SOLN |
| | Result: | 75,000 cps, pH 7 |
| 14-ii) | | 87.0% $H_2O$ |
| | | 10.0% clay |
| | | .5% Carbopol 676 |
| | | 2.5% S.C. SOLN (10%) |
| | Result: | 60,000 cps, pH 7 |
| 14-iii) | | 84.5% $H_2O$ |
| | | 10.0% clay |
| | | .5% Carbopol 676 |
| | | 5.0% S.C. SOLN (10%) |
| | Result: | 30,000 cps, pH 8 |

It should be noted, that the formulations of Examples 13 and 14 provide materials which are suitable for underground, re-pumpable applications. In general, however, Examples 1 to 14 clearly demonstrate the ability of the acrylic acid polymers to form a gelled material having a high viscosity, and thus, which would be suitable for application as a nitrate-free stemming material. The gels formed are preferably utilized as packaged stemming agents.

Material B

15) Bulk Stemming Formulation

Various formulations were prepared having a propylene carbonate concentration of from 1 to 4% by weight. The level of $SiO_2$ was adjusted accordingly.

| | |
|---|---|
| Formula: | 56 to 59% $SiO_2$ "N" |
| | 40% Standard Sand |
| | 1 to 4% Prop. Carb. |

| % Prop. Carb. | Result |
|---|---|
| 4 | Product hardened quickly in air, and under water — 10 minutes |
| 3 | Same as for 4% |
| 2 | Hardened slightly slower — 15 minutes in air and under water |
| 1 | Rubber-like set in 15 minutes in air and under water |

$SiO_2$ "N" is a mixture of $SiO_2/Na_2O$ in the ratio of 3.22:1

16) Dilute $SiO_2$ Test

This experiment was conducted to test the hardening properties of bulk stemming using various concentrations of $SiO_2$ "N" soln. The ratio of sand to $SiO_2$ was held constant at 60/40. Water was added to the $SiO_2$ in controlled amounts. The mixture was hardened using 2% propylene carbonate as neutralizing agent.

| Ratio of $SiO_2$ to $H_2O$ | Result |
|---|---|
| 100/0 (Control) | Hardened in 20 seconds |
| 90/10 | Hardened in 50 seconds |
| 80/20 | Hardened in 70 seconds |
| 70/30 | Hardened in 120 seconds |
| 60/40 | Hardened in 150 seconds |
| 50/50 | Hardened in 180 seconds |
| 40/60 | Hardened in 300 seconds |

17) Samples were tested for the effect of the concentration of the $SiO_2$ solution on the hardening properties of the stemming material, using a 5 second spatula mix time in order to mimic field applications. Otherwise, this experiment uses the same conditions as described in Example 16.

| Ratio of $SiO_2$ to $H_2O$ | Result |
|---|---|
| 100/0 | Hard in 15 minutes — Thin layer of liquid on top |
| 90/10 | Hard in 20 minutes — Thin layer of liquid on top |
| 80/20 | Hard in 20 minutes — Thin layer of liquid on top |
| 70/30 | Hard in 20 minutes — Thin layer of liquid on top |
| 60/40 | Hard in 20 minutes — Thin layer of liquid on top |
| 50/50 | Hard in 25 minutes — Thin layer of soft material, liquid on top |

18) Bulk Stemming

| Test #1 | | |
|---|---|---|
| Formula: | Sand | 60% |
| | $SiO_2$ N | 38% |
| | Prop. Carb. | 2% |
| | | 100% |

Result: Hard set under water after 5 minutes,

| Test #2 | | |
|---|---|---|
| Formula: | Sand | 60.0% |
| | $SiO_2$ N | 26.6% |
| | $H_2O$ | 11.4% |
| | Prop. Carb. | 2.0% |
| | | 100.0% |

Result: Hard set under water after 20–25 minutes,

| Test #3 | | |
|---|---|---|
| Formula: | Sand | 60% |
| | $SiO_2$ N | 19% |
| | $H_2O$ | 19% |
| | Prop. Carb. | 2% |
| | | 100% |

Result: Hard rubber-like after 30 minutes—slightly squeezable

19) Bulk Stemming

| | | |
|---|---|---|
| Formula: | Sand | 60% |
| | Prop. Carb. | 2% |
| | $SiO_2$ N | 38% |
| | | 100% |

Product hardened in 5 minutes in air and under water

| | | |
|---|---|---|
| Formula: | Sand | 60.0% |
| | Prop. Carb. | 1.5% |
| | $SiO_2$ N | 38.5% |
| | | 100% |

Product hardened in <10 minutes in air and under water

| | | |
|---|---|---|
| Formula: | Sand | 60% |
| | Prop. Carb. | 1% |
| | $SiO_2$ N | 39% |
| | | 100% |

Product hardened in 15–20 minutes in air and under water (hard rubber-like)

20) In this example, a stemming material that will quickly set to a hard mass, and which is suitable for underground applications, is demonstrated.

| | |
|---|---|
| Formula: | 86.0% "N" Sodium Silicate |
| | 10.0% Clay |
| | 4.0% Propylene Carbonate |

Procedure: Mixed clay into sodium silicate solution with a spatula. Prop. carb. was added and stirred for 10 seconds.

Result: The product became pasty quickly and set hard in 5 minutes.

21) A further series of experiments, similar to that shown in Example 20, was conducted wherein the amount and concentration of propylene carbonate, was studied in a clay-containing system.

| | | | |
|---|---|---|---|
| Formula A | Clay | 10.0% | Did not set hard under |
| | Prop. Carb. | 2.0% | water after 30 minutes |
| | $SiO_2$ N | 79.2% | |
| | $H_2O$ | 8.8% | |
| | | 100.0% | |
| Formula B | Clay | 10.0% | Set hard under water |
| | Prop. Carb. | 4.0% | after 20 minutes |
| | $SiO_2$ N | 77.4% | |
| | $H_2O$ | 8.6% | |
| | | 100.0% | |
| Formula C | Clay | 10.0% | Did not set hard under |
| | Prop. Carb. | 2.0% | water after 30 minutes |
| | $SiO_2$ N | 61.6% | |
| | $H_2O$ | 26.4% | |
| | | 100.0% | |
| Formula D | Clay | 10.0% | Set hard rubber-like |
| | Prop. Carb. | 4.0% | after 30 minutes |
| | $SiO_2$ N | 60.2% | |
| | $H_2O$ | 25.8% | |
| | | 100.0% | |
| Formula E | Clay | 10% | Did not set under |
| | Prop. Carb. | 2% | water after 30 minutes |

-continued

| | | | |
|---|---|---|---|
| | $SiO_2$ N | 44% | |
| | $H_2O$ | 44% | |
| | | 100% | |
| Formula F | Clay | 10% | Product set rubber- |
| | Prop. Carb. | 4% | like after 30 minutes |
| | Na $SiO_2$ "N" | 43% | |
| | $H_2O$ | 43% | |
| | | 100% | |
| Formula G | Clay | 20% | Product set hard <10 |
| | Prop. Carb. | 4% | minutes under water |
| | Na $SiO_2$ "N" | 66% | |
| | $H_2O$ | 10% | |
| | | 100% | |
| Formula H | Clay | 20% | Product set hard |
| | Prop. Carb. | 2% | rubber-like after |
| | Na $SiO_2$ "N" | 68% | 10 minutes under water |
| | $H_2O$ | 10% | |
| | | 100% | |
| Formula I | Clay | 20% | Rubber-like set after |
| | Prop. Carb. | 4% | 15 minutes under water |
| | Na $SiO_2$ "N" | 38% | |
| | $H_2O$ | 38% | |
| | | 100% | |

Examples 15 to 21 demonstrate that the system of silicate, sodium silicate solution and neutralizing material provides a nitrate-free stemming material that can set to a hard mass, even under water. The system is particularly adapted for bulk stemming operations.

Blends of Materials A and B

22) Bulk Stemming

| | |
|---|---|
| Formula: | 89.5% "K" Sodium Silicate soln. |
| | .5% Carbopol 690 |
| | 10.0% Clay (Celetom) |
| | 100% |
| | neutralized with 4% Propylene Carbonate |

Procedure: Mix clay and Carbopol 690 in beaker Add $SiO_2$ SOLN and mix well by hand. Add propylene carbonate and mix by hand Results: Final product became very pasty quickly.

Poured part of batch through water to test water resistance. The product hardened, under water, after 10 minutes.

23) Bulk Stemming

| | | |
|---|---|---|
| Formula: | 25.0% sand | |
| | 74.5% $SIO_2$ "K" | $SiO_2/Na_2O$ = 2.88 |
| | .5% Carbopol 690 | |
| | 100.0% Total | |

The mixture was then neutralized with propylene carbonate, as indicated below.

| Level of Prop. Carbonate | Result |
|---|---|
| 1% | Set rubbery in air and in water |
| 4% | Set hard in air and under water |

24) Bulk Stemming

| | | | |
|---|---|---|---|
| Formula: | 50.0% | sand | |
| | 49.5% | $SIO_2$ "K" | $SiO_2/Na_2O = 2.88$ |
| | .5% | Carbopol 690 | |
| | 100.0% | Total | |

Result: With 1% propylene carbonate - pasty mix, set (hard) rubber-like after 10 minutes in air and under $H_20$ 25) Bulk Stemming

| | | | |
|---|---|---|---|
| Formula: | 75.0% | sand | |
| | 24.5% | $SIO_2$ "K" | $SiO_2/Na_2O = 2.88$ |
| | .5% | Carbopol 690 | |
| | 100.0% | Total | |

Result: With 1% propylene carbonate - very dry and clumpy - did not form a solid single mass. Did not harden under water.

With 4% propylene carbonate - very dry and clumpy - did not form a solid single mass. Did not harden under water.

26) Bulk Stemming

| | | | |
|---|---|---|---|
| Formula: | 40.0% | sand | |
| | 59.5% | $SIO_2$ "K" | $SiO_2/Na_2O = 2.88$ |
| | .5% | Carbopol 690 | |
| | 100.0% | Total | |

Results: With 4% propylene carbonate - Good, hard set after 10 minutes - in air and under $H_2O$ 27) Bulk Stemming

| | | | |
|---|---|---|---|
| Formula: | 47.5% | sand | |
| | 2.5% | clay | |
| | 49.5% | $SIO_2$ "K" | $SiO_2/Na_2O = 2.88$ |
| | .5% | Carbopol 690 | |
| | 100.0% | Total | |

Result: With 2% propylene carbonate — taffy-like, dry mix set hard after 10 minutes in air and under $H_2O$ With 4% propylene carbonate — taffy-like, dry mix set hard after 20 minutes in air and under $H_2O$ With 1% - propylene carbonate — taffy-like, dry mix set hard after 10 minutes — in air and under $H_2O$ (Soft under water — did not totally set to a hard mass — rubbery)

In an additional experiment with 1% clay, 1% propylene carbonate, the formulation given above produced a taffy-like, dry mix which set to a hard mass after 10 minutes in air (Soft under water — did not set — rubbery)

28) Bulk Stemming - Sample formulations and results

| | Test 1 | Test 2 | Test 3 | Test 4 | Test 5 |
|---|---|---|---|---|---|
| Sand | 60 | 60 | 60 | 50 | 50 |
| Carbopol 676 | 0.5 | 0.5 | 0.5 | 0.5 | 0.5 |
| Propylene Carbonate | 2.0 | 2.0 | 2.0 | 2.0 | 2.0 |
| $SiO_2$ "N" | 18.75 | 16.25 | 37.5 | 23.75 | 33.25 |
| $H_2O$ | 18.75 | 11.25 | — | 23.75 | 14.25 |
| Result: Time to hard set (min.) | 25* | 25 | 7 | 20* | 20 |

* — Rubber-like hard set

29) Bulk Stemming - Sample formulations and results

| | Test 1 | Test 2 | Test 3 |
|---|---|---|---|
| Sand | 60 | 60 | 60 |
| Carbopol 676 | 0.2 | 0.2 | 0.2 |
| Propylene Carbonate | 2.0 | 2.0 | 2.0 |
| $SiO_2$ "N" | 37.8 | 18.9 | 22.68 |
| $H_2O$ | — | 18.9 | 15.12 |
| Result: Time to hard set (min.) | 10 | 20* | 20* |

* — Rubber-like hard set

30) This experiment is similar to experiment No. 29 except that the propylene carbonate is replaced by acetic anhydride (A.A.)

| Test No. 1: | | |
|---|---|---|
| Formula: | Sand | 60.0% |
| | A.A. | 2.0 |
| | $SiO_2$ "N" | 38.0 |

Result: Hard set in air very quickly (<10 sec.) When tested under water, the water solubility of the acetic anhydride interfered with the ability of the system to set to a hard mass. These results are presented hereinbelow, as tests 2, 3 and 4.

| | Test 2 | Test 3 | Test 4 |
|---|---|---|---|
| Sand | 60 | 60 | 60 |
| Carbopol 676 | 0.2 | 2.0 | 2.0 |
| Acetic Anhydride | 2.0 | 1.0 | 0.66 |
| Methanol | — | 1.0 | 1.34 |
| $SiO_2$ "N" | 18.9 | 18.9 | 18.9 |
| $H_2O$ | 18.9 | 18.9 | 18.9 |

All formulations (for Tests 2 to 4) failed to set under water. Under dry conditions, the system provided a stemming material suitable for use.

Accordingly, Examples 22 to 30 provide evidence of the ability of mixtures of a silicon oxide-containing material, a silicate solution and an acrylic acid polymer, together with an acidic material, to form a nitrate-free stemming material.

Having described specific embodiments of the present invention, it will be understood that modifications thereof may be suggested to those skilled in the art, and it is intended to cover all such modifications as fall within the scope of the appended claims.

The embodiments of the invention in which an exclusive property or privilege is claimed are defined as follows:

1. A stemming agent comprising at least one of the following components:

A) 0–100% by weight of a solution of a neutralized acrylic acid polymer, and

B) 0–100% by weight of a mixture of from about 1 to 95 weight percent of a silicon oxide-containing material combined with a neutralized silicate solution, and combinations thereof.

2. A stemming agent as claimed in claim 1 wherein said agent is nitrate-free.

3. A stemming agent as claimed in claim 1 comprising 0–100% by weight of a mixture of from about 10 to 70 weight percent of a silicon oxide-containing material combined with a neutralized silicate solution.

4. A stemming agent as claimed in claim 1 wherein said agent is 100 weight percent of an aqueous neutralized acrylic acid polymer.

5. A stemming agent as claimed in claim 1 wherein said agent is 100 weight percent of a mixture of from about 1 to 95 weight percent silicon dioxide containing material combined with a neutralized silicate solution.

6. A stemming agent as claimed in claim 1 wherein said agent is 100 weight percent of a mixture of from about 10 to 70 weight percent silicon dioxide containing material combined with a neutralized silicate solution.

7. A stemming agent as claimed in claim 1 wherein said solution of acrylic acid polymer is neutralized by diethanolamine or sodium carbonate.

8. A stemming agent as claimed in claim 4 comprising 9.0 to 99.8% water and 0.2 to 1.0% by weight of an acrylic acid polymer which has been partially or completely neutralized.

9. A stemming agent as claimed in claim 1 wherein said silicate solution is a sodium silicate solution having from 30 to 60%, by weight, of a mixture of $SiO_2$ and $Na_2O$ in a 3:1 ratio.

10. A stemming agent as claimed in claim 3 wherein said silicate solution is a sodium silicate solution having from about 30 to 60%, by weight, of a mixture of $Si_2$ and $Na_2O$ in a 3:1 ratio.

11. A stemming agent as claimed in claim 1 wherein said silicate solution is neutralized by a mineral acid, an organic acid, an organic acid anhydride, or propylene carbonate.

12. A bulk nitrate-free stemming agent comprising a mixture of from about 1 to 95% of a silicon oxide-containing material with 99 to 5% of a sodium silicate solution which has been neutralized by the addition of a mineral acid, an organic acid, an organic acid anhydride or propylene carbonate.

13. A bulk nitrate-free stemming agent comprising a mixture of from about 10 to 70% of a silicon oxide-containing material with 90 to 30% of a sodium silicate solution which has been neutralized by the addition of a mineral acid, an organic acid, an organic acid anhydride or propylene carbonate.

14. A bulk nitrate-free stemming agent as claimed in claim 12 comprising a mixture of from about 1 to 95% of a silicon oxide-containing material with 99 to 5% of a sodium silicate solution which has been neutralized by the addition of an acrylic acid polymer.

15. A bulk nitrate-free stemming agent as claimed in claim 13 comprising a mixture of from about 10 to 70% of a silicon oxide-containing material with 90 to 30% of a sodium silicate solution which has been neutralized by the addition of an acrylic acid polymer.

* * * * *